US010302388B1

(12) United States Patent
Brown

(10) Patent No.: US 10,302,388 B1
(45) Date of Patent: May 28, 2019

(54) HANDGUARD ATTACHMENT MECHANISM

(71) Applicant: AMBIMJB, LLC, Baltimore, MD (US)

(72) Inventor: Michael Jay Brown, Baltimore, MD (US)

(73) Assignee: AMBIMJB, LLC, Baltimore, MD (US)

( * ) Notice: Subject to any disclaimer, the term of this patent is extended or adjusted under 35 U.S.C. 154(b) by 0 days.

(21) Appl. No.: 16/229,622

(22) Filed: Dec. 21, 2018

Related U.S. Application Data

(60) Provisional application No. 62/632,460, filed on Feb. 20, 2018.

(51) Int. Cl.
*F41C 23/16* (2006.01)
*F41G 11/00* (2006.01)

(52) U.S. Cl.
CPC ..... *F41C 23/16* (2013.01); *F41G 11/003* (2013.01)

(58) Field of Classification Search
CPC ..... F41C 23/16
USPC ..... 42/71.01, 72, 73
See application file for complete search history.

(56) References Cited

U.S. PATENT DOCUMENTS 9,453,694 B1 * 9/2016 Storch ..... F41A 3/64
9,791,239 B1 * 10/2017 Kincel ..... F41C 23/16

* cited by examiner

*Primary Examiner* — Reginald S Tillman, Jr.
(74) *Attorney, Agent, or Firm* — Wood Herron & Evans LLP

(57) ABSTRACT

Provided is a mechanism for attaching a handguard to a firearm upper receiver that has a pivot lug for attachment to a lower receiver. The mechanism includes a barrel nut having an exterior surface and an annular groove, a handguard having an attachment portion with an axial opening to receive at least a portion of the exterior surface of the barrel nut including the annular groove, and a cross bore that, when the axial opening is assembled onto the barrel nut, substantially corresponds in position to the annular groove and that at least partially intersects the axial opening. The handguard has rearwardly extending fingers that engage opposite sides of the upper receiver pivot lug and a fastener, when inserted into the cross bore, engages the annular groove.

6 Claims, 8 Drawing Sheets

HANDGUARD ATTACHMENT MECHANISM

CROSS-REFERENCE TO RELATED APPLICATIONS

This application claims the benefit of priority to U.S. Provisional Patent Application Ser. No. 62/632,460, filed on Feb. 20, 2018, the disclosure of which is incorporated by reference herein.

TECHNICAL FIELD

This invention relates to a mechanism for attaching a handguard to the upper receiver, via the barrel nut, of an AR-pattern firearm. More particularity, it relates to a simplified mechanism to secure the handguard against axial and/or rotational displacement.

BACKGROUND

Many mechanisms have been devised for attaching a handguard to the upper receiver of an AR-pattern firearm, including attachment to the barrel nut. In each case, the challenge is to provide a simple mechanism that secures the handguard against both axial and rotational displacement relative to the upper receiver. Some have used specialized barrel nuts that provide an attachment interface with radially oriented fasteners. Others have used clamping mechanisms, some of which draw together a longitudinal split in a rear portion of the handguard. Each of these has drawbacks and limitations in function, durability, and/or cost.

SUMMARY OF THE INVENTION

The present invention provides a mechanism for attaching a handguard to an AR-pattern upper receiver that secures it against both axial and rotational displacement. It uses a specially configured barrel nut that is engaged by a transverse fastener that does not need to deform the handguard with clamping force. Small fingers on the handguard engage the pivot trunnion of the standard upper receiver and act as stops to prevent rotational displacement.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
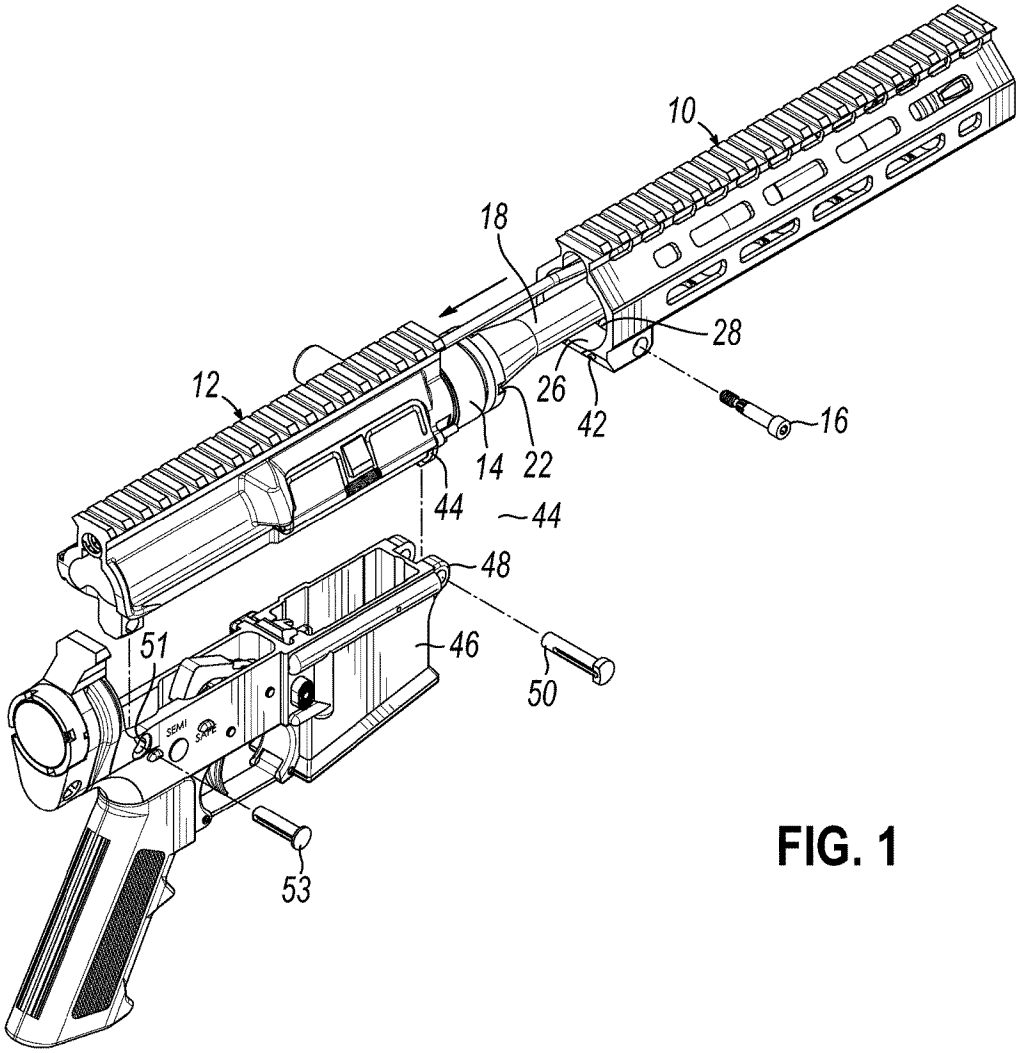
FIG. 1 is a partially exploded isometric view of an AR-pattern firearm using a handguard attachment mechanism according to an embodiment of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

Referring first to FIG. 1, therein is shown a mechanism for assembling a handguard 10 to an upper receiver 12 of an AR-pattern firearm. The mechanism includes a barrel nut 14 that is specially adapted to receive the handguard 10 and a transverse fastener 16. The barrel nut 14 threads onto a treaded forward extension of the upper receiver 12 to secure the barrel 18 in the ordinarily and well-known manner. Rather than having a radial flange found in a typical AR-pattern barrel nut, the barrel nut 14 of the present invention includes an annular grove 20 and is otherwise of a generally uniform outside profile. A forward edge of the barrel nut 14 may include a plurality of circumferentially spaced notches 22 for engagement with a tool for tightening or removal.

Figure 2:
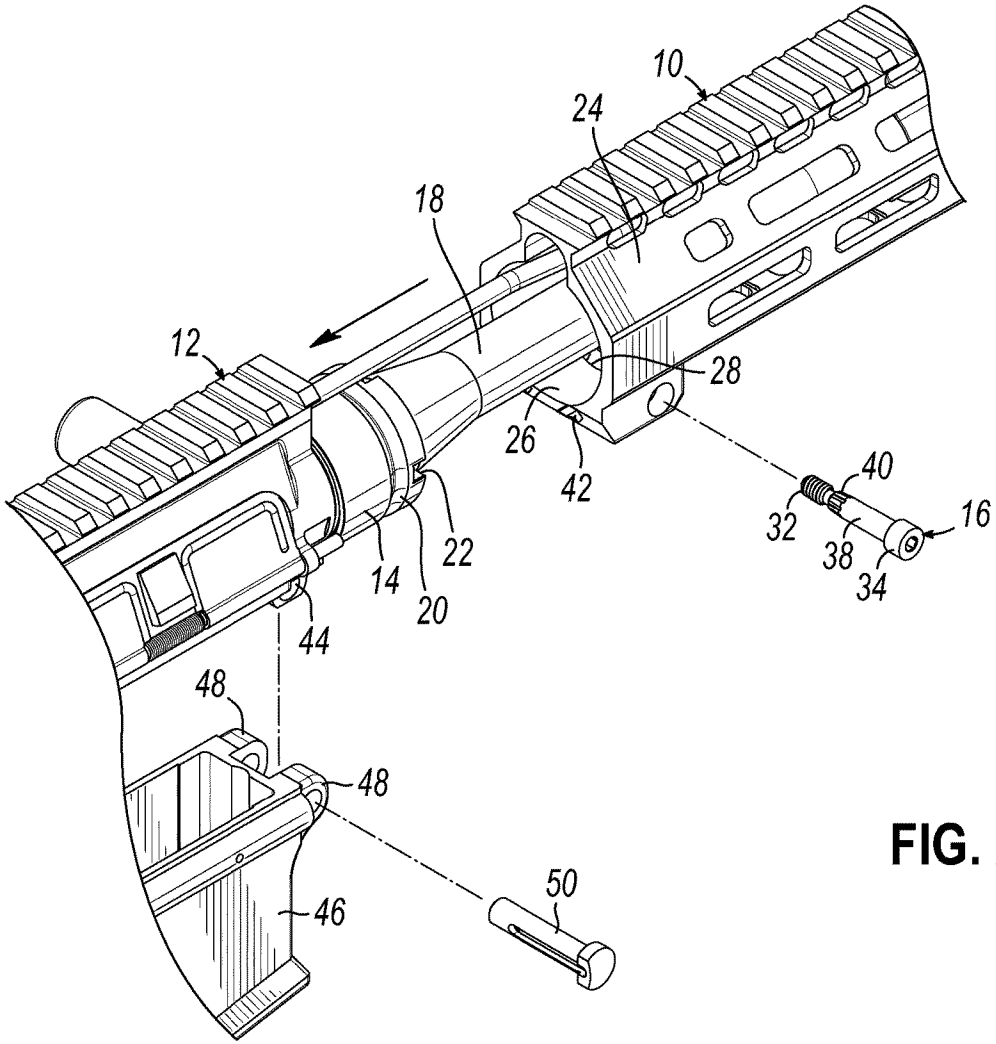
FIG. 2 is an enlarged, fragmentary, exploded isometric view thereof.
Figure 3:
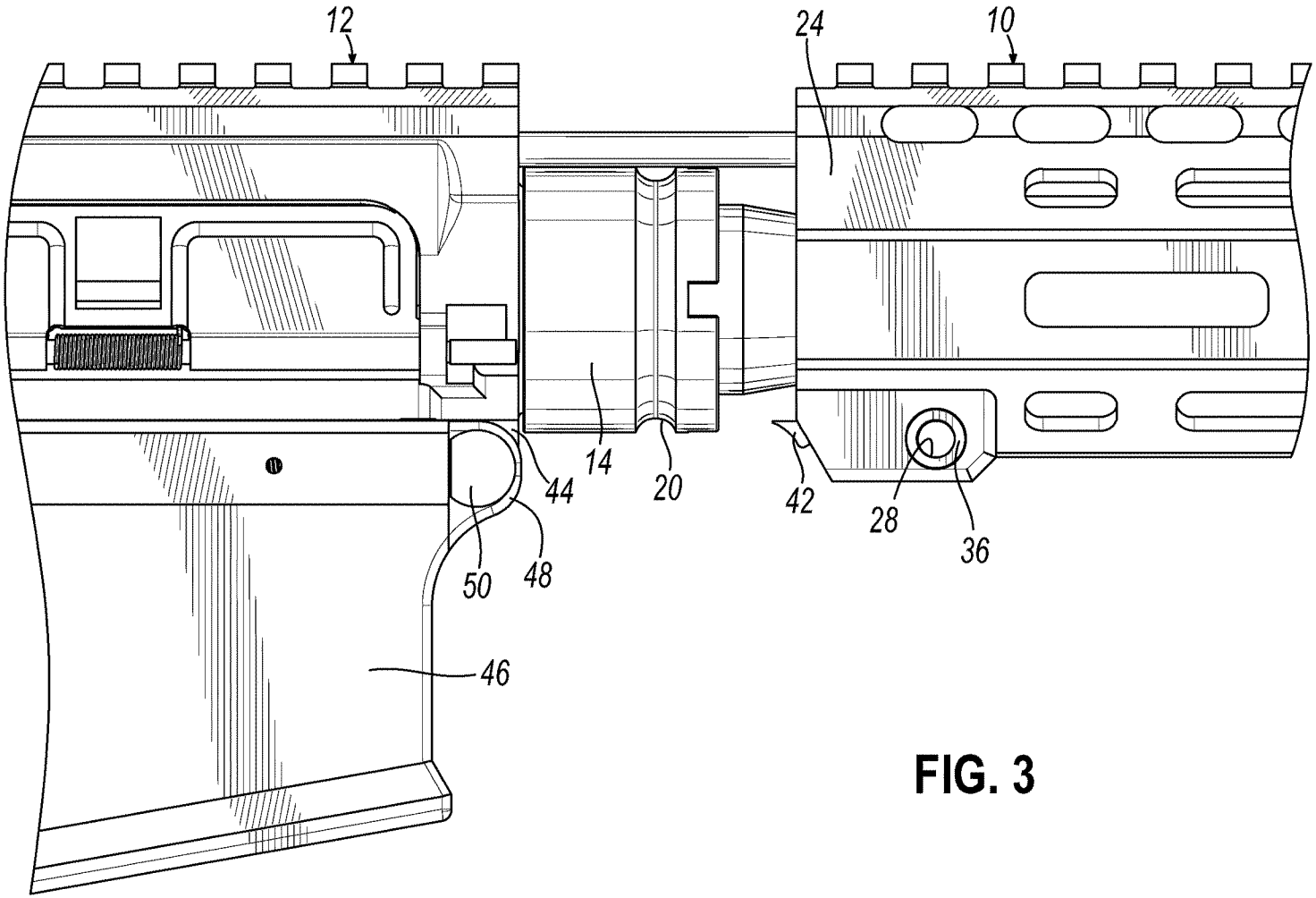
FIG. 3 is a fragmentary side view showing a handguard being assembled to the barrel nut of an AR-pattern upper and lower receiver.
Figure 5:
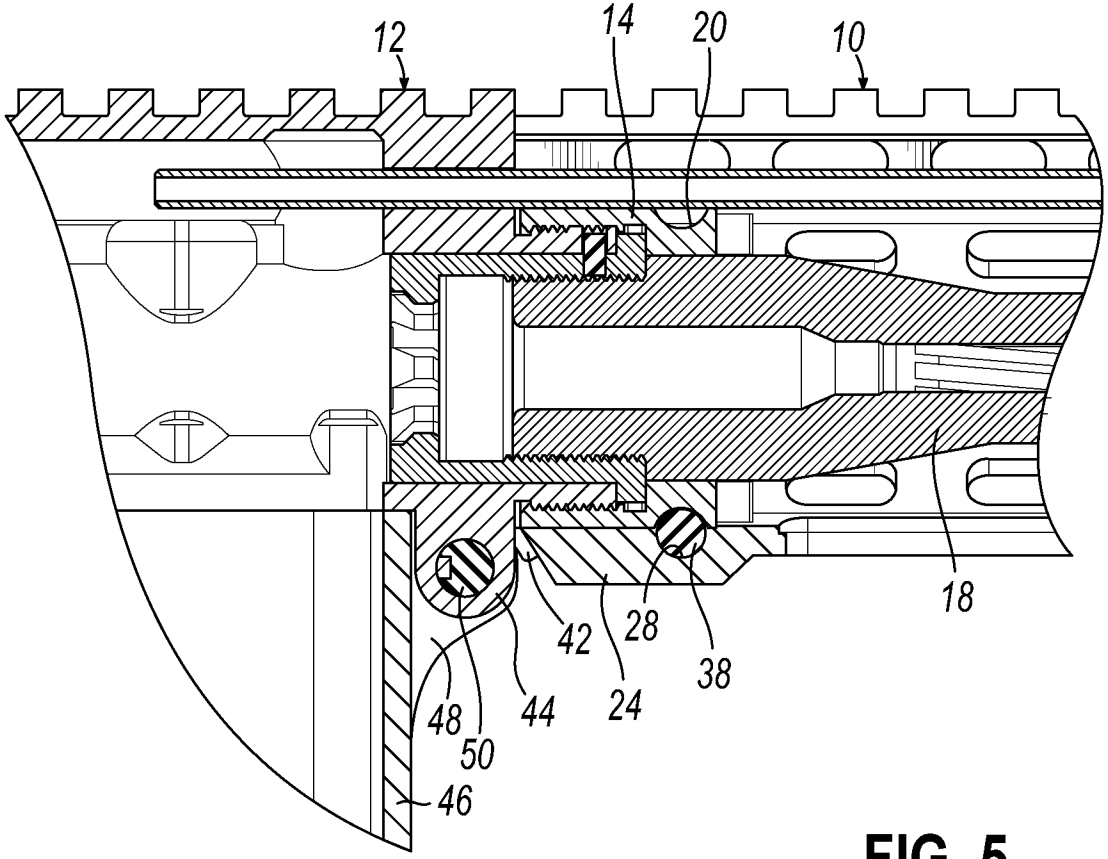
FIG. 5 is a side sectional view thereof.
Figure 6:
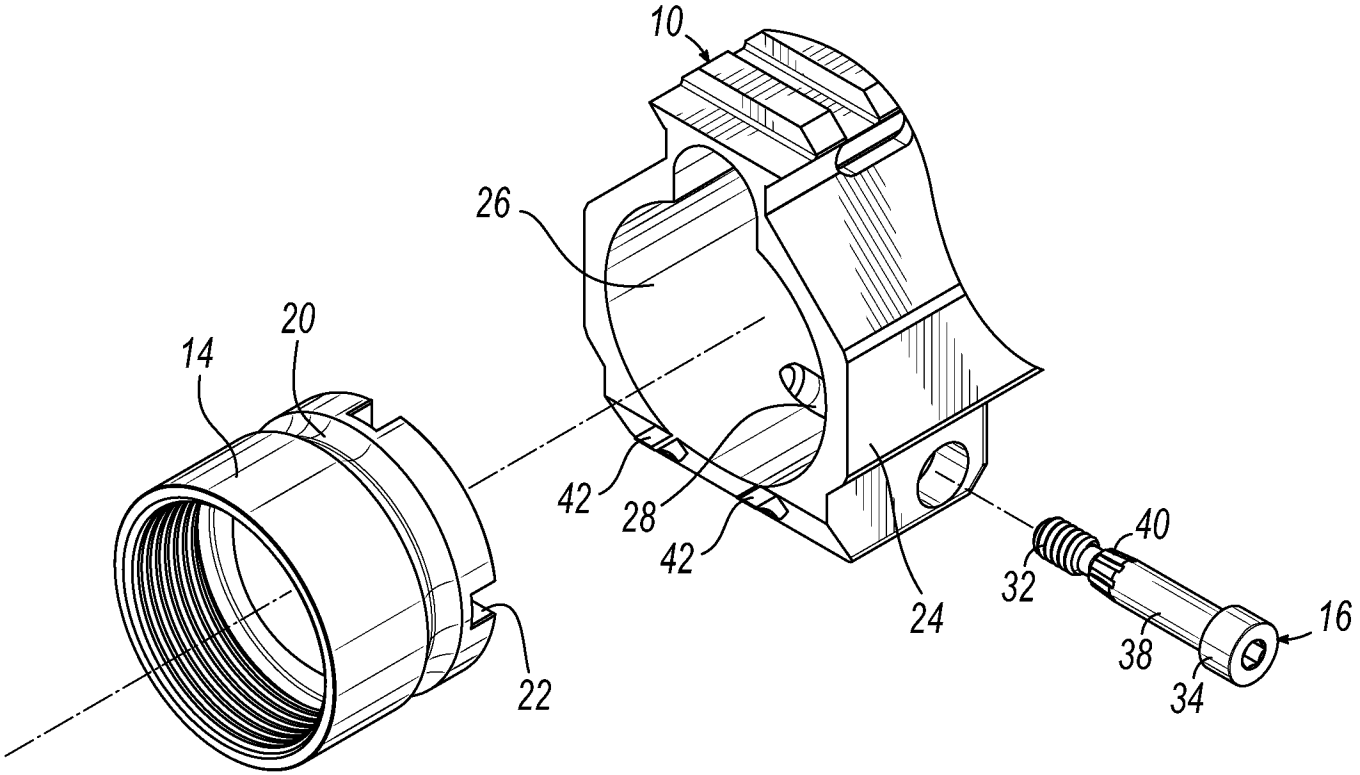
FIG. 6 is a fragmentary isometric view of a handguard shown relative to a fastener and barrel nut according to an embodiment of the present invention.

The handguard 10 includes an attachment portion 24 at its rearward end with a longitudinal opening 26 sized to closely receive the outer surface of the barrel nut 14 when axially slid into position for assembly, as shown by the arrow in FIGS. 1-3. In the illustrated embodiment, the profile of both the longitudinal opening 26 and outer surface of the barrel nut 14 is circular. While this shape is the simplest, other corresponding shapes could be used, as well. The attachment portion 24 also includes a cross bore 28 that is oriented substantially perpendicular to the longitudinal or axial direction of the barrel 18, handguard 10, and longitudinal opening 26. As illustrated in FIGS. 5 and 6, the cross bore 28 partially intersects the longitudinal opening 26. The annular grove 20 of the barrel nut 14 is axially positioned to at least partially receive the transverse fastener 16 when inserted into the cross bore 28 after the longitudinal opening 26 of the handguard 10 has been positioned over the barrel nut 14. The cross bore 28 includes a threaded portion 30 into which a threaded end portion 32 of the transverse fastener 16 may be engaged. The transverse fastener 16 may also include a shoulder portion 34 that is configured to seat within a countersink 36 of the cross bore 28 to limit the insertion depth of the fastener 16. In this manner, tightening of the fastener 16 in the cross bore 28 does not circumferentially compress or "clamp" together parts of the attachment portion 24 against the barrel nut 14.

Figure 8:
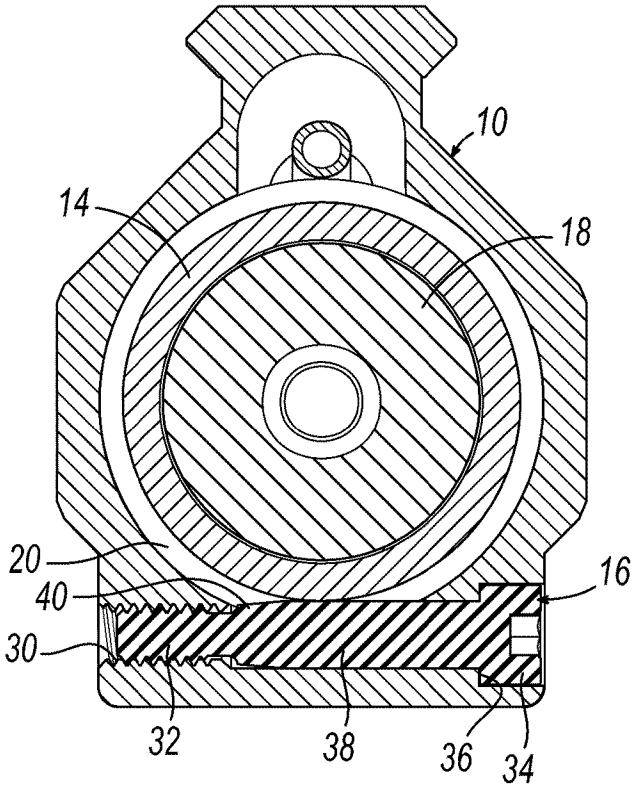
FIG. 8 is a cross sectional view taken substantially along line 8-8 of FIG. 7.

As best illustrated in FIGS. 5 and 8, the location of the cross bore 28 relative to the annular grove 20 of the barrel nut 14 may be slightly "proud," such as by about 0.005 inch. That is, when the handguard 10 is fitted onto the barrel nut 14, before the fastener 16 is inserted, the longitudinal position of the cross bore 28 is very slightly forward of the annular groove 20. In this manner, the handguard 10 is drawn snug against the upper receiver 12 upon insertion of the fastener, eliminating any gap or play in the connection. The threaded end portion 32 of the transverse fastener 16 is reduced in diameter relative to the shank portion 38, which provides this interference fit. Between the threaded end portion 32 and the shank portion 38 can be a tapered portion 40, which will guide the fastener 16 as it is inserted into position relative to the annular grove 20 of the barrel nut 14. The tapered portion 40 can act to cam the slight offset of the cross bore 28 relative to the position of the annular groove 20 as the fastener 16 is inserted. By making the major diameter of the threaded end portion 32 smaller than the diameter of the shank portion 38, the threads will not be damaged and forces will be borne by the shank portion 38 of the fastener 16.

According to another aspect of the invention, a pair of fingers 42 may be provided that extend rearwardly from a lower edge region of the attachment portion 24 of the handguard 10. These fingers 42 act as rotational stops and engage opposite sides of the upper receiver's pivot lug or trunnion 44 when the handguard 10 is assembled in place over the barrel nut 14 on the upper receiver 12. The pivot trunnion 44 of the upper receiver 12 is used to assemble it to an AR-pattern lower receiver 46 between forward pivot yoke flanges 48 of the lower receiver 46. The upper receiver 12 is connected at its forward end to the lower receiver 46 by a transverse pivot pin 50 and a rear lug 51 is secured with a rear take-down pin 53 in the well-known manner. The take-down pin 53 may be disengaged while the forward pivot pin 50 remains connected, allowing the upper receiver assembly to pivot on the forward pin 50, exposing internal parts without completely separating the upper receiver 12 from the lower receiver 16.

Figure 4:
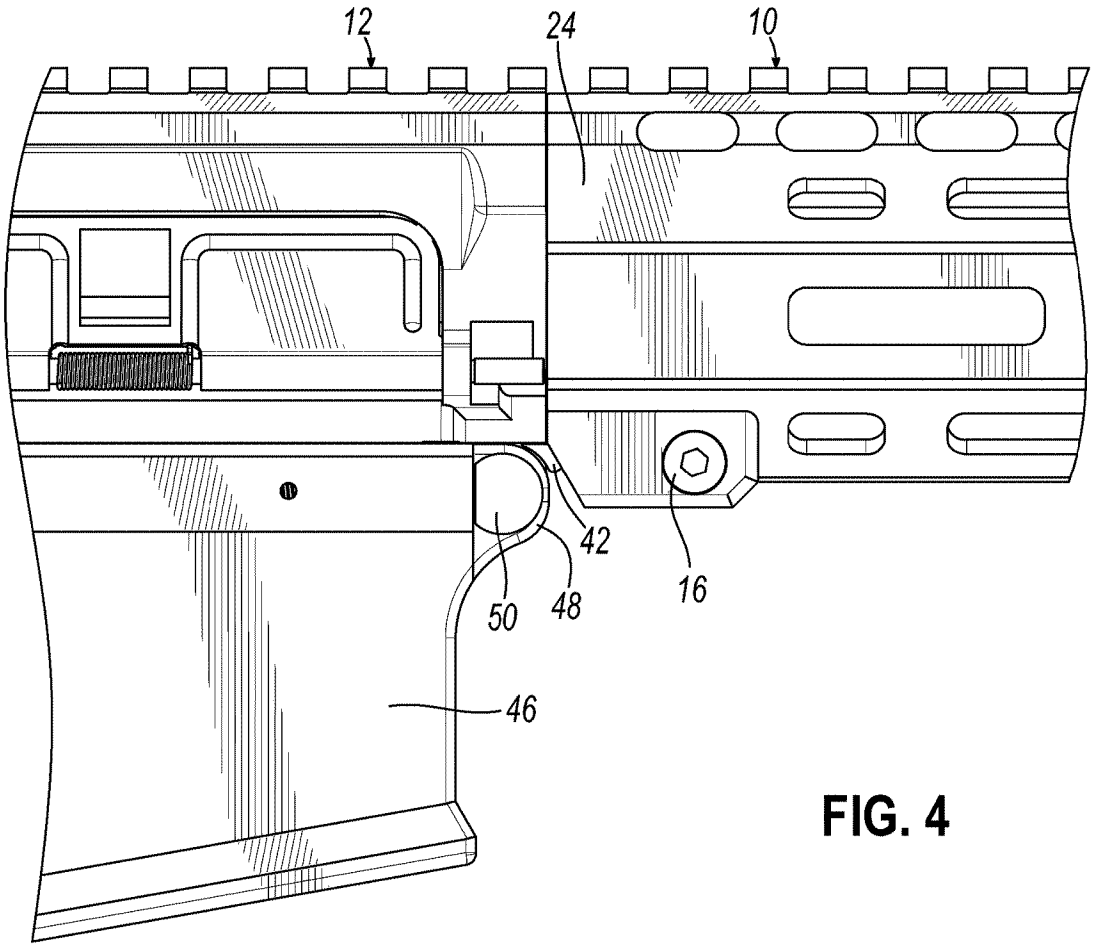
FIG. 4 is a fragmentary side view showing a handguard assembled to the barrel nut of an AR-pattern upper and lower receiver.
Figure 7:
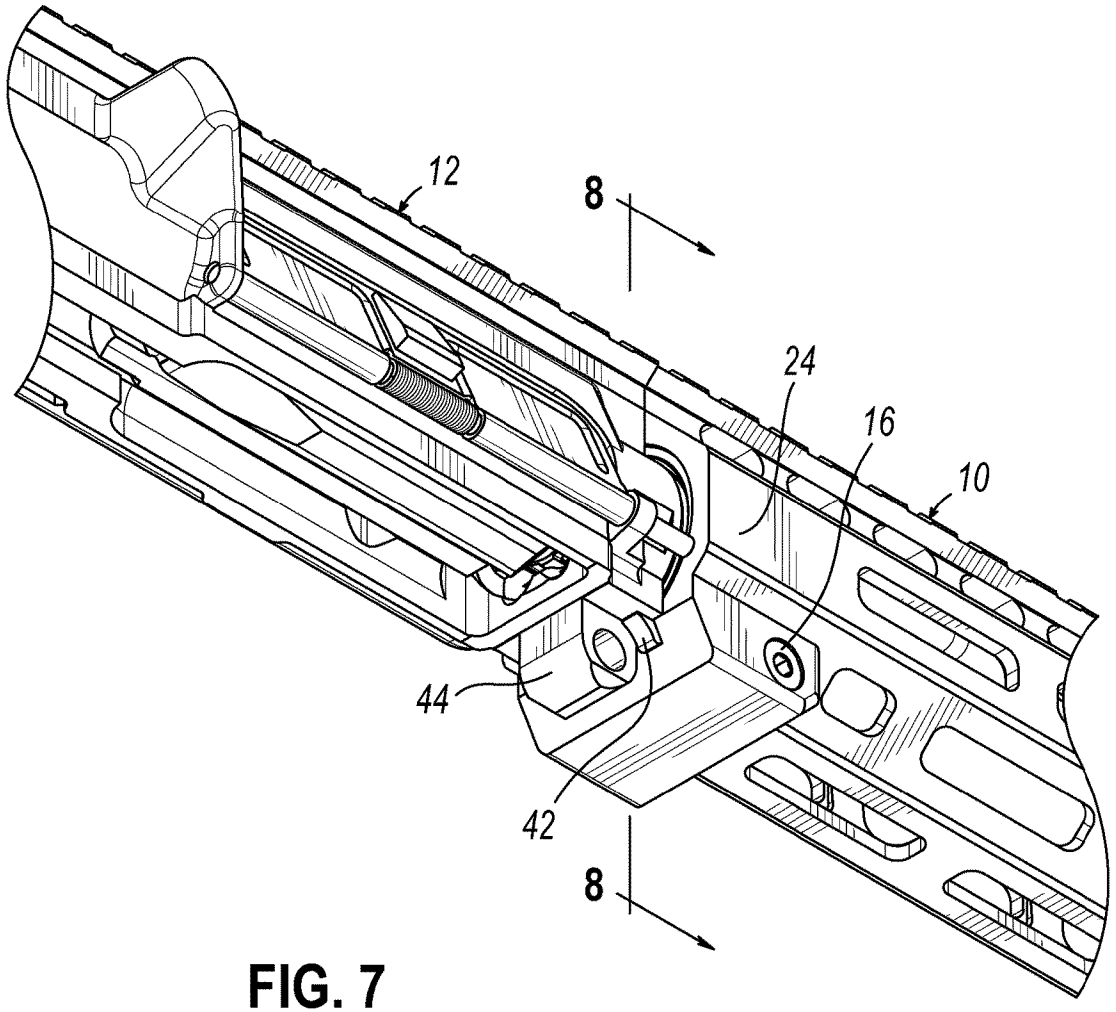
FIG. 7 is a fragmentary enlarged view of the handguard assembled to an upper receiver.

According to an aspect of one embodiment, the fingers 42 may be shaped to engage opposite sides of the pivot trunnion 44 while maintaining clearance from the pivot yolk flanges 48 of the lower receiver 46. The pivot yolk flanges 48 are necessarily rounded at their forward/upper edge to allow the assembled upper receiver 12 and handguard 10 to pivot about the pivot pin 50 without complete disconnection, as previously described. The fingers 42 may be relatively small in size and yet effective to resist sheer forces placed on them if there is an attempt to rotate the handguard 10 relative to the upper receiver 12 after assembly. Although some dimensions and ornamental features of AR-pattern upper and lower receivers may vary, the area occupied by the fingers 42 (see FIGS. 4 and 7) universally will remain unobstructed and unoccupied by other structure so that the upper and lower parts can rotate on the forward pivot pin 50. Protrusions that engage another part of the upper receiver and/or handguard may not accurately mate between different brands or styles of the AR-pattern.

Accordingly, a ridged connection between the handguard 10 and upper receiver 12 is provided that resists both axial and rotational displacement using a minimum number of parts and without bending (circumferential compression) forces being placed on the attachment portion 24 of the handguard 10 in order to clamp the handguard 10 to the barrel nut 14. Likewise, an ordinary upper receiver 12 and lower receiver 46 may be used without requiring special structure or modification. The mechanism uses a minimal number of parts and can be produced at a lower cost than other available alternatives.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims

What is claimed is:

1. A mechanism for attaching a handguard to a firearm upper receiver, the receiver having a pivot lug for attachment to a lower receiver, comprising:

a barrel nut having an exterior surface and an annular groove;

a handguard having an attachment portion including an axial opening to receive at least a portion of the exterior surface of the barrel nut including the annular groove, having a cross bore that, when the axial opening is assembled onto the barrel nut, substantially corresponds in position to the annular groove and that at least partially intersects the axial opening;

the handguard having rearwardly extending fingers that engage opposite sides of the upper receiver pivot lug; and a fastener that, when inserted into the cross bore, engages the annular groove.

2. The attachment mechanism of claim 1, wherein the fingers are positioned to extend horizontally under the upper receiver on opposite sides of the upper receiver pivot lug and have a curved bottom surface.

3. The attachment mechanism of claim 1, wherein the fastener has a shank and a threaded end portion that engages a threaded portion of the cross bore.

4. The attachment mechanism of claim 3, wherein fastener threads have a major diameter smaller than the shank diameter.

5. The attachment mechanism of claim 3, wherein the fastener has a tapered portion positioned between the shank and threaded end portion.

6. The attachment mechanism of claim 1, wherein the cross bore is offset away from the receiver relative to the annular groove by about 0.005 inch, whereby insertion of the fastener draws the handguard toward the receiver.

* * * * *